US006986266B2

(12) United States Patent
Narinsky

(10) Patent No.: US 6,986,266 B2
(45) Date of Patent: Jan. 17, 2006

(54) PROCESS AND APPARATUS FOR LNG ENRICHING IN METHANE

(75) Inventor: George B. Narinsky, Boston, MA (US)

(73) Assignee: Cryogenic Group, Inc., Murrieta, CA (US)

( * ) Notice: Subject to any disclaimer, the term of this patent is extended or adjusted under 35 U.S.C. 154(b) by 83 days.

(21) Appl. No.: 10/664,846

(22) Filed: Sep. 22, 2003

(65) Prior Publication Data

US 2005/0061029 A1 Mar. 24, 2005

(51) Int. Cl.
*F25J 3/00* (2006.01)

(52) U.S. Cl. ..... 62/620; 62/118; 62/627

(58) Field of Classification Search ..... 62/611, 62/613, 618, 620, 621, 622, 627
See application file for complete search history.

(56) References Cited

U.S. PATENT DOCUMENTS

| | | | | |
|---|---|---|---|---|
| 2,952,984 | A * | 9/1960 | Marshall, Jr. | 62/622 |
| 3,837,172 | A * | 9/1974 | Markbreiter et al. | 62/621 |
| 5,114,451 | A * | 5/1992 | Rambo et al. | 62/623 |
| 5,359,856 | A * | 11/1994 | Rhoades et al. | 62/611 |
| 5,588,306 | A * | 12/1996 | Schmidt | 62/623 |
| 6,564,579 | B1 | 5/2003 | McCartney | |
| 6,907,752 | B2 * | 6/2005 | Schroeder et al. | 62/620 |
| 2003/0005722 | A1 * | 1/2003 | Wilkinson et al. | 62/620 |

* cited by examiner

*Primary Examiner*—Cheryl Tyler
*Assistant Examiner*—Richard L. Leung
(74) *Attorney, Agent, or Firm*—William W. Haefliger

(57) ABSTRACT

Process and apparatus for separation of LNG allow both maximum enriching of the methane product in methane at any initial LNG composition, and to production the methane product in fully liquid state for the customer.

13 Claims, 8 Drawing Sheets

FIG. 1a.

TABLE 1

| | Initial | Methane Product | Ethane Product |
|---|---|---|---|
| Flow rate, Nm^3/b | 10000 | 8755 | 1245 |
| Pressure, bara/paia | 1.05/15.2 | 1.35/19.6 | 6.07/88.0 |
| Temperature K | 112.6 | 114.6 | 238 |
| Vapor Mole Fraction | 0.0 | 0.0 | 0.0 |
| Component mole fraction | | | |
| - nitrogen | 0.003 | 0.00343 | 0.0 |
| - methane | 0.858 | 0.98 | 0.0 |
| - ethane | 0.096 | 0.01657 | 0.6546 |
| - propane | 0.030 | 0.0 | 0.2410 |
| - I-butane | 0.010 | 0.0 | 0.0803 |
| - I-pentane | 0.002 | 0.0 | 0.0161 |
| - n-hexane | 0.001 | 0.0 | 0.0080 |

FIG. 1b.

TABLE 2

Figure 1:
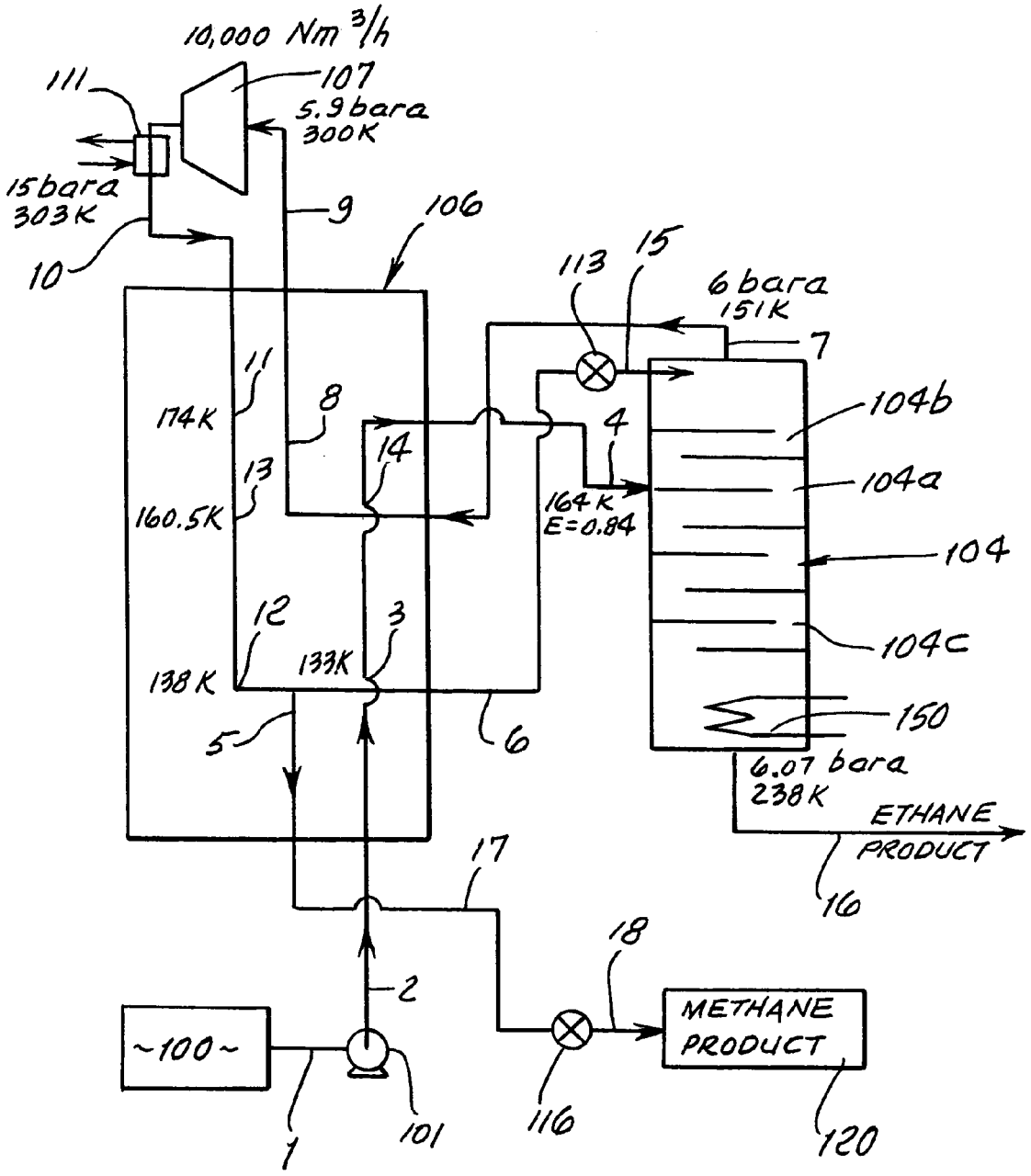

The parameters of the scheme of the LNG enriching plant according to the Figure 1 (the distillation column pressure is 6 bara (87 psia)

| No | Flow rate V. mol/mol LNG | Temperature T. K | Pressure P bara | Vapor mole fraction E. | Composition (see Fig. 1a) |
|---|---|---|---|---|---|
| 1 | 1.0 | 112.6 | 1.05 | 0.0 sat. | Initial LNG |
| 2 | 1.0 | 112.9 | 6.1 | 0.0 | Initial LNG |
| 3 | 1.0 | 132.4 | 6.09 | 0.0 | Initial LNG |
| 4 | 1.0 | 164.0 | 6.03 | 0.84 | Initial LNG |
| 5 | 0.8755 | 138.0 | 14.9 | 0.0 | Methane product |
| 6 | 0.1245 | 138.0 | 14.9 | 0.0 | Methane product |
| 7 | 1.0 | 151.4 | 6.0 | 1.0 sat. | Methane product |
| 8 | 1.0 | 164.0 | 5.95 | 1.0 | Methane product |
| 9 | 1.0 | 300.0 | 5.9 | 1.0 | Methane product |
| 10 | 1.0 | 303.0 | 15.0 | 1.0 | Methane product |
| 11 | 1.0 | 174.1 | 14.95 | 1.0 | Methane product |
| 12 | 1.0 | 138.0 | 14.9 | 0.0 | Methane product |
| 13 | 1.0 | 160.5 | 14.93 | 0.79 | Methane product |
| 14 | 1.0 | 151.4 | 6.07 | 0.72 | Initial LNG |
| 15 | 0.1245 | 138.2 | 6.0 | 0.0 | Methane product |
| 16 | 0.1245 | 238.0 | 6.07 | 0.0 sat. | Ethane product |
| 17 | 0.8755 | 114.6 | 14.85 | 0.0 | Methane product |
| 18 | 0.8755 | 114.6 | 1.35 | 0.0 sat. | Methane product |

The Temperature (T) of the streams in the heat exchanger vs. Enthalpy (H) of the Direct streams.
To Fig 1: the distillation column pressure is 6.0 bara (87.0 psia).

FIG. 2a.

TABLE 3

| | Initial | Methane Product | Ethane Product |
|---|---|---|---|
| Flow rate, Nm^3/b | 10000 | 8755 | 1245 |
| Pressure, bara/paia | 1.4/20.3 | 1.2/17.4 | 1.27/18.4 |
| Temperature K | 116.6 | 113.1 | 197 |
| Vapor Mole Fraction | 0.0 | 0.0 | 0.0 |
| Component mole fraction | | | |
| - nitrogen | 0.003 | 0.00343 | 0.0 |
| - methane | 0.858 | 0.98 | 0.0 |
| - ethane | 0.096 | 0.01657 | 0.6546 |
| - propane | 0.030 | 0.0 | 0.2410 |
| - I-butane | 0.010 | 0.0 | 0.0803 |
| - I-pentane | 0.002 | 0.0 | 0.0161 |
| - n-hexane | 0.001 | 0.0 | 0.0080 |

FIG. 2b.

TABLE 4

Figure 2:
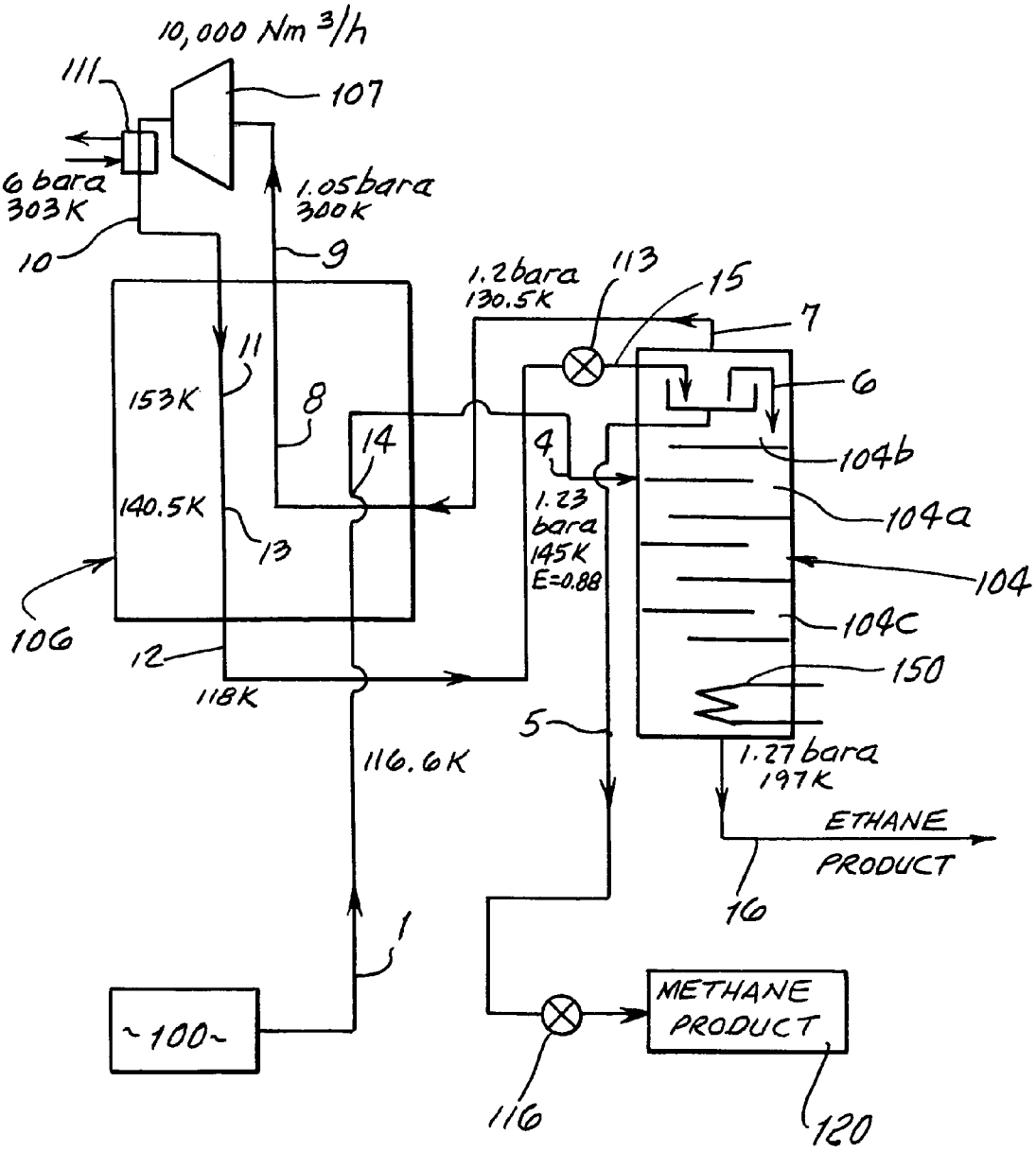

The parameters of the scheme of the LNG enriching plant according to the Figure 2 (the distillation column pressure is 1.2 bara (17.4 psia)

| No | Flow rate V, mol/mol LNG | Temperature T, K | Pressure P, bara | Vapor mole fraction E, | Composition (see Fig.2a) |
|---|---|---|---|---|---|
| 1 | 1.0 | 116.6 | 1.4 | 0.0 sat. | Initial LNG |
| 4 | 1.0 | 145.2 | 1.23 | 0.88 | Initial LNG |
| 5 | 0.8755 | 113.1 | 1.2 | 0.0 sat. | Methane product |
| 6 | 0.091 | 113.1 | 1.2 | 0.0 sat. | Methane product |
| 7 | 1.0 | 130.5 | 1.2 | 1.0 sat. | Methane product |
| 8 | 1.0 | 145.2 | 1.15 | 1.0 | Methane product |
| 9 | 1.0 | 300.0 | 1.05 | 1.0 | Methane product |
| 10 | 1.0 | 303.0 | 6.0 | 1.0 | Methane product |
| 11 | 1.0 | 153.1 | 5.95 | 1.0 | Methane product |
| 12 | 1.0 | 118.0 | 5.9 | 0.0 | Methane product |
| 13 | 1.0 | 140.5 | 5.93 | 0.82 | Methane product |
| 14 | 1.0 | 130.5 | 1.3 | 0.81 | Initial LNG |
| 15 | 1.0 | 113.4 | 1.2 | 0.034 | Methane product |
| 16 | 0.1245 | 197.0 | 1.27 | 0.0 sat. | Ethane product |

The Temperature (T) of the streams in the heat exchanger vs. Enthalpy (H) of the Direct streams. To Fig. 2: the distillation column pressure is 1.2 bara (17.4 psia).

PROCESS AND APPARATUS FOR LNG ENRICHING IN METHANE

FIELD OF THE INVENTION

This invention relates to a process and apparatus for separation of a liquefied natural gas (LNG) to produce a methane enriched liquid (methane product) and an ethane enriched liquid (ethane product).

BACKGROUND OF THE PRIOR ART

One process for separation of liquid hydrocarbons containing two or more carbon atoms (ethane product) from LNG and to produce natural gas meeting pipeline specifications is disclosed in U.S. Pat. No. 6,564,579. That process comprises: vaporizing the LNG to produce a partially vaporized natural gas stream; fractionating the partially vaporized natural gas stream to produce a gas stream and a liquid stream(ethane product); compressing the gas stream to increase the pressure of the gas stream by about 50 to about 150 psi to produce a compressed gas stream and cooling the compressed gas stream by heat exchange with the stream of LNG to produce a liquid compressed stream; pumping the liquid compressed stream to produce a high-pressure liquid stream at a pressure from about 800 to about 1200 psig; vaporizing the high pressure liquid stream to produce a conditioned natural gas suitable for delivery to a pipeline or for commercial use; recovering the liquid ethane product.

In that process, the distillation column comprises only one stripping section and uses as a reflux the liquid of the partially vaporized natural gas stream. This severely limits the possibilities of enriching methane content in the distillation column overhead stream, and requires a great fraction of liquid in the partially vaporized natural gas stream. In addition, compressing of the enriched in methane gas stream is carried out at low temperatures. In so doing, much heat is introduced in the system, not only from the distillation column reboiler but also from the compressor. This does not allow production of the enriched in methane stream in fully liquid state for the end user, without also using outside refrigeration. There is need for an improved process for separation of LNG to produce a methane enriched product, and an ethane enriched product.

SUMMARY OF THE INVENTION

The present invention provides improvements that enable maximum enriching of the methane product in methane at any initial LNG composition, and production of the methane product in fully liquid state, for the customer.

The first improvement is provided by use of part of the enriched in methane liquid stream as a reflux for the distillation column that comprises two sections (concentration and stripping). The partially vaporized initial LNG stream is typically fed into the middle region of the distillation column.

The second improvement involves use of a methane cycle wherein the enriched in methane gas stream is compressed at ambient temperature. For this purpose, the distillation column overhead enriched in methane stream is warmed in a heat exchanger, compressed and cooled by water to the ambient temperature. Thereafter the compressed stream is cooled in the heat exchanger.

Another objective comprises providing a process that comprises: feeding the initial LNG stream to the heat exchanger where the initial LNG stream partially vaporizes:

feeding the partially vaporized initial LNG stream into the middle of a distillation column comprising a concentration (upper) and a stripping (lower) section; separating the partially vaporized initial LNG stream into a methane enriched overhead gas stream and an ethane enriched bottom liquid stream (ethane product) in the distillation column; warming the methane enriched gas stream in the heat exchanger; compressing the warmed methane enriched gas stream by a compressor and cooling by heat exchange with water to the ambient temperature; cooling and liquefying the compressed and cooled by water methane enriched stream in the heat exchanger; distributing the liquefied compressed methane enriched stream between two streams one of which throttles and introduces to the top of the distillation column as a reflux and the other is supercooled in the heat exchanger and thereafter throttled and introduced to the storage for methane product.

These and other objects and advantages of the invention, as well as the details of an illustrative embodiment, will be more fully understood from the following specification and drawings, in which:

DRAWING DESCRIPTION

Figure 1C:
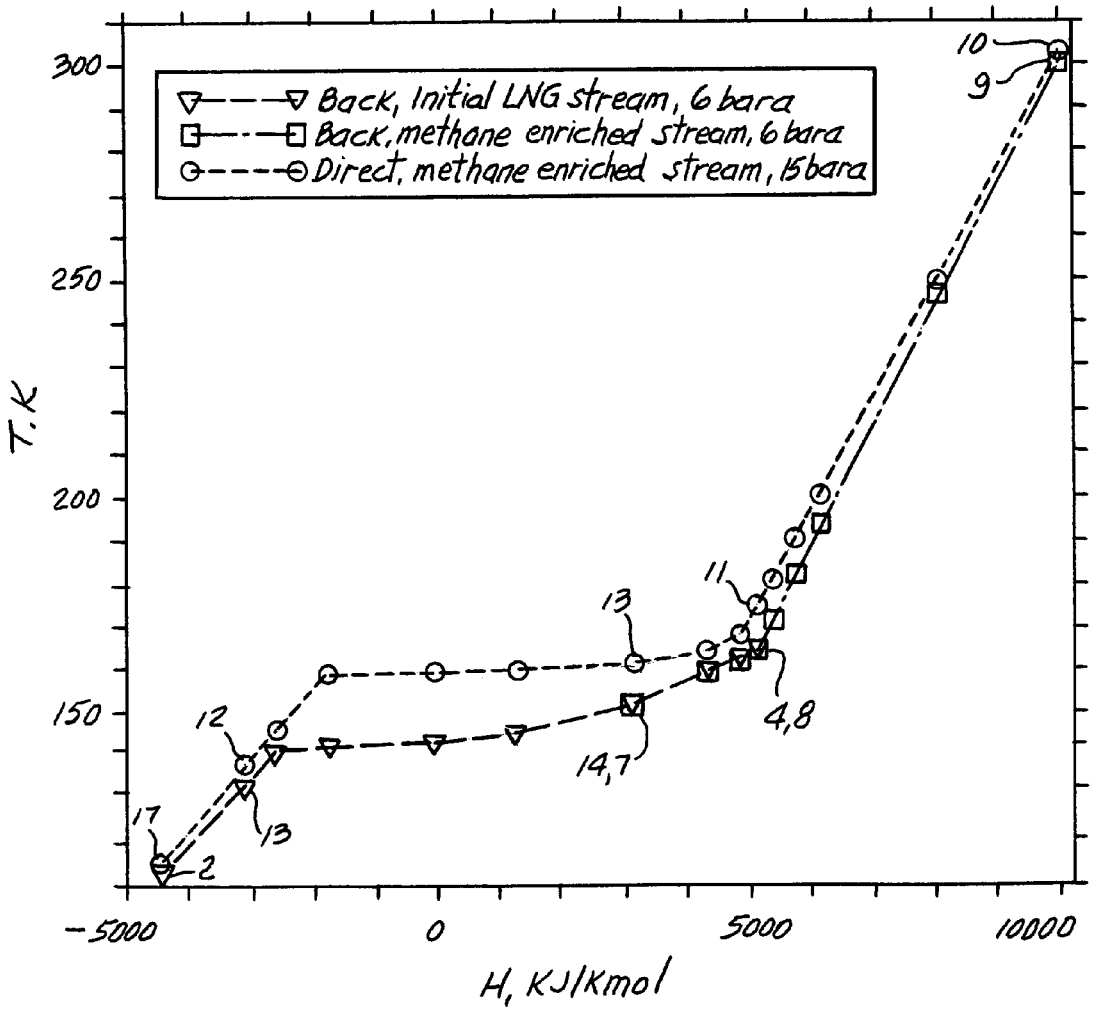

FIG. 1 is a flow diagram showing a preferred system for producing methane and ethane products, from LNG;

FIGS. 1*a* and 1*b* are parameter tables;

FIG. 1*c* is a graph showing T.K. vs H,kJ/kmol;

FIG. 2 is a flow diagram of a modified system;

FIGS. 2*a* and 2*b* are parameter tables; and

Figure 2C:
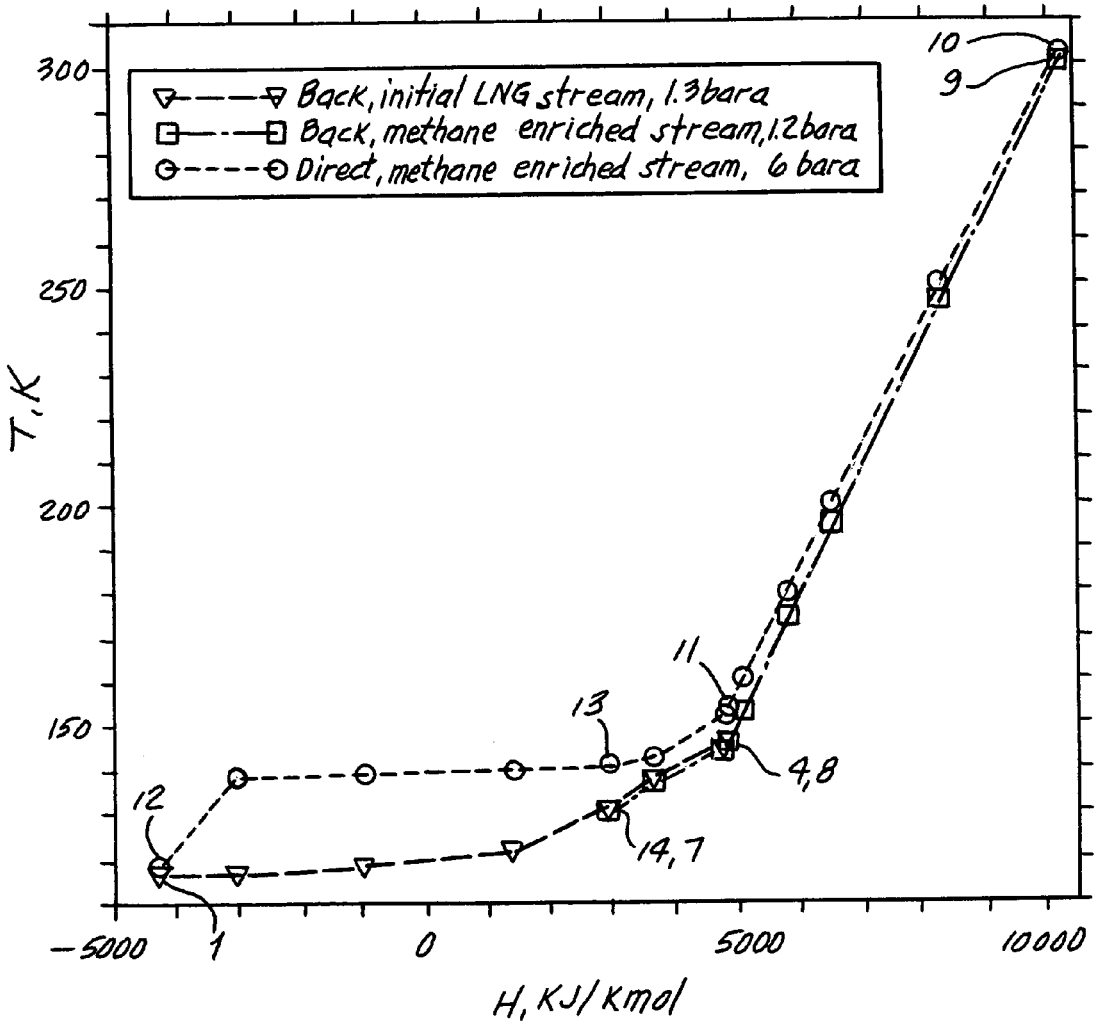

FIG. 2*c* is a graph showing T.K. vs H,kJ/kmol;

DETAILED DESCRIPTION

Referring to FIG. 1, a source of initial LNG is indicated at 100. It is supplied at 1 and 2, via pump 101, to a heat exchanger 106, in which the LNG partially vaporizes due to heating. The partially vaporized LNG stream is fed at 4 into the middle region 104*a* of a distillation column 104 having concentration (upper) and stripping (lower) section 104*b* and 10*c*. A reboiler is provided at 150. Operation of the column effects separation of the partially vaporized stream into a methane enriched overhead gas stream at 7, and an ethane enriched bottom liquid stream (ethane product) removed at 16.

The methane enriched stream 7 is then fed to heat exchanger 106 wherein the stream is heated (for example to 300 K) as indicated at 9, following flow at 8. The stream then is fed to a compressor 107 wherein its pressure is increased, for example from 5.9 bara to 15 bara.

The compressed stream is cooled by water in a compressor end cooler 111 to the ambient temperature, for example to 303 K.

The compressed and water cooled stream is then fed at 10 to a heat exchanger 106 wherein the stream is cooled and liquefied, through heating at 8 of the removed from the distillation column methane enriched overhead gas stream and vaporizing the initial LNG stream.

The liquefied stream is then delivered at 12 for distribution in two streams, indicated at 5 and 6. Stream 6 is throttled (expanded, as in an expansion valve 113, and subsequently introduced at 15 to the top of the upper section 104*b* of the distillation column, as a reflux. Stream 5 is supercooled as in exchanger 106, as by heat exchange in or with the initial stream, and is then throttled (expanded as in expansion valve 116), for subsequent introduction at 18 to methane product storage or use 120. Numeral 17 indicates flow from the exchanger 106 to the valve 116. The valves 113 and 116 are controlled to thereby control the relative flow distributions of the two streams indicated at 5 and 6, and controlling methane product 120. Such controls may be incorporated into 113 and 116.

Typical operating parameters, at points 1 through 18 of the process are indicated in FIG. 1, and also in following:

TABLE 1 (FIG. 1*a*),

TABLE 2 (FIG. 1*b*),

GRAPH (FIG. 1*c*).

In FIG. 1, the distillation column pressure is 6.0 bara (87.0 psia).

FIG. 2 illustrates a similar process, wherein the distillation column pressure is 1.2 bara (17.4 psia). In FIG. 2, the stream delivered at 12 is passed via the valve 113 and subsequently introduced at 15 to the top region of the distillation column, wherein the stream is distributed into reflux stream 6, and stream 5 containing methane, passed via valve 116 to methane product storage as described above. Operating parameters for the FIG. 2 process appear in the following:

TABLE 3 (FIG. 2*a*),

TABLE 4 (FIG. 2*b*),

GRAPH (FIG. 2*c*).

Features of the invention also include:

1) A process for LNG enriching in methane by using a methane cycle comprising the steps of:

a) feeding the initial LNG stream to the heat exchanger where the initial LNG stream partially vaporizes;

b) feeding the partially vaporized initial LNG stream into the middle of a distillation column comprising a concentration (upper) and a stripping (lower) sections;

c) separating the partially vaporized initial LNG stream into a methane enriched overhead gas stream and an ethane enriched bottom liquid stream (ethane product) in the distillation (column);

d) warming the methane enriched gas stream in the heat exchanger;

e) compressing the warmed methane enriched gas stream by a compressor and cooling by heat exchange with water to the ambient temperature;

f) cooling and liquefying the compressed and cooled by water methane enriched stream in the heat exchanger;

g) distributing the liquefied compressed methane enriched stream between two streams one of which is throttled (expanded) and introduced to the top of the distillation column as a reflux; and the other is super cooled in the heat exchanger and thereafter is throttled (expanded) and introduced to the storage for methane product. Control of the expansion steps controls relative distribution of flows in the two streams.

2) Features of 1) above wherein the initial LNG is pumped from the storage to the heat exchanger.

3) Features of 1) and 2) above wherein the partially vaporized initial LNG stream is separated into a methane enriched overhead gas stream, an ethane enriched liquid stream (ethane product) removing from an intermediate tray in the distillation column, and a propane-butane enriched bottom liquid (propane-butane product) in the distillation column.

4) Features of 1), 2) and 3) above wherein the distillation column pressure is 1.05–5.0 bara (15–72 psia), and the compressor discharge pressure is 4–12 bara (58–174 psia).

5) Features of 1), 2) and 3) above wherein the distillation column pressure is 5–12 bara (72–174 psia) and the compressor discharge pressure is 12–25 bara (174–363 psia).

6) Features of 1) and 3) above wherein the distillation column pressure is 1.2–1.5 bara (17–22 psia) and the liquefied compressed methane enriched stream of step f) is throttled and introduced to the top of the distillation column and thereafter distributed between two streams one of which is used as reflux and the other introduced to the storage for methane product.

7) Features of 1), 2) and 5) above wherein the composition of the initial LNG is 0.3% of nitrogen, 85.8% of methane, 9.6% of ethane, 3% of propane, 1% of i-butane, 0.3% of total i-pentane and n-hexane; and the composition of the methane product is typically 0.34% of nitrogen, 98% of methane, 1.7% of ethane; and the composition of the ethane product is typically 65.5% of ethane, 24.1% of propane, 8% of i-butane, 2.4% of total i-pentane and n-hexane; the distillation column pressure is 6 bara (87 psia), the compressor discharge pressure is 15 bara (217 psia); the vapor mole fraction of the partially vaporized initial LNG at introduction to the distillation column is 0.84; and the number of theoretical trays in the distillation column is 4 in the upper section 8 in the lower section and the total being 12.

8) Features of 1), 2), 3), 5) and 7) above wherein the composition of the ethane product is 1.3% of methane, 75.8% of ethane, 21.9% of propane, 1% of i-butane, the composition of the propane-butane product is 0.2% of ethane, 34.5% of propane, 49% of i-butane, 16.3% of total i-pentane and n-hexane; the number of theoretical trays in the distillation column is in upper section 4, in middle section 3, in lower section 5, and the total is 12.

9) Feature of 1), 6) and 7) above wherein the distillation column pressure is 1.2 bara (17 psia), the compressor discharge pressure is 6 bara (87 psia); the vapor mole fraction of the partially vaporized initial LNG at introduction to the distillation column is 0.88%; the number of theoretical trays in the distillation column is in upper section 4, in lower section 8, and the total being 12.

10) Features of 1), 2), 3), 4), 5) and 6) above wherein due to increase, the temperature difference at the warm end of the heat exchanger, the methane compressor discharge pressure decreases.

11) Apparatus for LNG enriching in methane by use of the methane cycle in accordance with the invention, includes a) a distillation column for separating the partially vaporized initial LNG stream into a methane enriched overhead gas stream and an ethane enriched bottom liquid stream (ethane product), or into a methane enriched overhead gas stream, an ethane enriched intermediate liquid stream (ethane product) and a propane-butane enriched bottom liquid stream (propane-butane product);

b) a reboiler for vaporizing the liquid that flows down in the distillation column;

c) a compressor for increasing the pressure of the methane enriched gas stream;

d) a heat exchanger for cooling and liquefying the compressed methane enriched stream through heating the removed from the distillation column methane enriched overhead gas stream and vaporizing the initial LNG stream;

e) a storage for the initial LNG;

f) a pump for increasing the pressure of the initial LNG;

g) a storage for the methane product;

h) a storage for the ethane product (storage for the ethane product and propane-butane product).

I claim:

1. A process for enriching LNG in methane, comprising the steps:

a) feeding an initial LNG stream to flow in a first path in a heat exchanger wherein the LNG stream partially vaporizes, b) feeding the partially vaporized initial LNG stream into a middle region of a distillation column that has a concentration section and a stripping section, c) operating the distillation column to separate the partially vaporized initial LNG stream into a methane enriched overhead gas stream and into an ethane enriched liquid product stream, d) warming the methane enriched gas stream while flowing in a second path in the heat exchanger, e) compressing the warmed methane enriched gas stream, and cooling the compressed methane enriched gas stream to a temperature at or near ambient, f) further cooling the compressed and cooled methane enriched gas stream to liquid state while flowing in a third path in the heat exchanger, g) and distributing the compressed and liquefied methane enriched gas stream into two streams, one of which is expanded and then introduced to the top of the distillation column as a reflux, and the other of which is expanded and provided as a methane product.

2. The process of claim 1 wherein step a) includes pumping the initial LNG from a storage region to said heat exchanger.

3. The process of claim 1 wherein said ethane enriched liquid stream is removed from an intermediate tray in the distillation column, and wherein a propane-butane enriched bottom liquid is produced in the distillation column, as a propane-butane product.

4. The process of claim 1 wherein the fluid pressure in the distillation column is between 72–174 psia; an upper compressor is employed to compress the methane enriched gas stream in step e), the compressor having a discharge pressure between 174 and 363 psia.

5. The process of claim 1 wherein said other stream is derived from said one stream, within the distillation column.

6. A process for enriching LNG in methane, comprising the steps:

a) feeding an initial LNG stream to a heat exchanger wherein the LNG stream partially vaporizes, b) feeding the partially vaporized initial LNG stream into a middle region of a distillation column that has a concentration section and a stripping section, c) operating the distillation column to separate the partially vaporized initial LNG stream into a methane enriched overhead gas stream and into an ethane enriched liquid product stream, d) warming the methane enriched gas stream, e) compressing the warmed methane enriched gas stream, and cooling the compressed methane enriched gas stream to a temperature at or near ambient, f) further cooling the compressed and cooled methane enriched gas stream to liquid state, g) and distributing the compressed and liquefied methane enriched gas stream into two streams, one of which is expanded and then introduced to the top of the distillation column as a reflux, and the other of which is expanded and provided as a methane product, h) and wherein the fluid pressure in the distillation column is between 15 and 72 psia; and wherein a compressor is employed to compress the methane enriched gas stream in step e), the compressor having a discharge pressure between 58 and 174 psia.

7. A process for enriching LNG in methane, comprising the steps:

a) feeding an initial LNG stream to a heat exchanger wherein the LNG stream partially vaporizes, b) feeding the partially vaporized initial LNG stream into a middle region of a distillation column that has a concentration section and a stripping section, c) operating the distillation column to separate the partially vaporized initial LNG stream into a methane enriched overhead gas stream and into an ethane enriched liquid product stream, d) warming the methane enriched gas stream, e) compressing the warmed methane enriched gas stream, and cooling the compressed methane enriched gas stream to a temperature at or near ambient, f) further cooling the compressed and cooled methane enriched gas stream to liquid state, g) and distributing the compressed and liquefied methane enriched gas stream into two streams, one of which is expanded and then introduced to the top of the distillation column as a reflux, and the other of which is expanded and provided as a methane product, h) and wherein the step g) expansions are throttling processes, which are controlled to thereby control the relative flow distributions of said two streams.

8. A process for enriching LNG in methane, comprising the steps:

a) feeding an initial LNG stream to a heat exchanger wherein the LNG stream partially vaporizes, b) feeding the partially vaporized initial LNG stream into a middle region of a distillation column that has a concentration section and a stripping section, c) operating the distillation column to separate the partially vaporized initial LNG stream into a methane enriched overhead gas stream and into an ethane enriched liquid product stream, d) warming the methane enriched gas stream, e) compressing the warmed methane enriched gas stream, and cooling the compressed methane enriched gas stream to a temperature at or near ambient, f) further cooling the compressed and cooled methane enriched gas stream to liquid state, g) and distributing the compressed and liquefied methane enriched gas stream into two streams, one of which is expanded and then introduced to the top of the distillation column as a reflux, and the other of which is expanded and provided as a methane product, h) and wherein the composition of the initial LNG is about 0.3% of nitrogen, about 85.8% of methane, about 9.6% of ethane, about 3% of propane, about 1% of i-butane, about 0.3% of total i-pentane and n-hexane; the composition of the methane product is about 0.34% of nitrogen, about 98% of methane, about 1.7% of ethane; and the composition of the ethane product is about 65.5% of ethane, about 24.1% of propane, about 8% of i-butane, about 2.4% of total i-pentane and n-hexane, wherein said stated percentages are mol percentages.

9. The method of claim 8 wherein the fluid pressure in the distillation column is 6 bara (87 psia); a compressor is employed to compress the methane enriched gas stream in step e), the compressor having a discharge pressure of 15 bara (217 psia); the vapor mole fraction of the partially vaporized initial LNG at introduction to the distillation column is 0.84%; the number of theoretical trays in the distillation column is 12, including 4 trays in the tower upper section, and 8 trays in the tower lower section.

10. A process for enriching LNG in methane, comprising the steps:

a) feeding an initial LNG stream to a heat exchanger wherein the LNG stream partially vaporizes, b) feeding the partially vaporized initial LNG stream into a middle region of a distillation column that has a concentration section and a stripping section, c) operating the distillation column to separate the partially vaporized initial LNG stream into a methane enriched overhead gas stream and into an ethane enriched liquid product stream, d) warming the methane enriched gas stream, e) compressing the warmed methane enriched gas stream, and cooling the compressed methane enriched gas stream to a temperature at or near ambient, f) further cooling the compressed and cooled methane enriched gas stream to liquid state, g) and distributing the compressed and liquefied methane enriched gas stream into two streams, one of which is expanded and then introduced to the top of the distillation column as a reflux, and the other of which is expanded and provided as a methane product, h) said ethane enriched stream being removed from an intermediate tray in the distillation column, and wherein a propane-butane enriched bottom liquid is produced in the distillation column, as a propane-butane product, and i) and wherein the composition of the ethane product is about 1.3% of methane, about 75.8% of ethane, about 21.9% of propane, about 1% of i-butane; the composition of the propane-butane product is about 0.2% of ethane, about 34.5% or propane, about 49% of i-butane, about 16.3% of total i-pentane and n-hexane; the number of theoretical trays in the distillation column is 12, including 4 trays in the tower upper section, 3 trays in the tower middle section, and 5 trays in the tower lower section, wherein said stated percentages are mol percentages.

11. A process for enriching LNG in methane, comprising the steps:

a) feeding an initial LNG stream to a heat exchanger wherein the LNG stream partially vaporizes, b) feeding the partially vaporized initial LNG stream into a middle region of a distillation column that has a concentration section and a stripping section, c) operating the distillation column to separate the partially vaporized initial LNG stream into a methane enriched overhead gas stream and into an ethane enriched liquid product stream, d) warming the methane enriched gas stream, e) compressing the warmed methane enriched gas stream, and cooling the compressed methane enriched gas stream to a temperature at or near ambient, f) further cooling the compressed and cooled methane enriched gas stream to liquid state, g) and distributing the compressed and liquefied methane enriched gas stream into two streams, one of which is expanded and then introduced to the top of the distillation column as a reflux, and the other of which is expanded and provided as a methane product, h) and wherein fluid pressure in the distillation column is about 1.2 bara (17 psia), the compression discharge pressure is about 6 bara (87 psia); the vapor mole fraction of the partially vaporized initial LNG at introduction to the distillation column is about 0.88; and the number of theoretical trays in the distillation column is 12, including 4 trays in a tower upper section, and 8 trays in tower lower section.

12. A process for enriching LNG in methane, comprising the steps:

a) feeding an initial LNG stream to a heat exchanger wherein the LNG stream partially vaporizes, b) feeding the partially vaporized initial LNG stream into a middle region of a distillation column that has a concentration section and a stripping section, c) operating the distillation column to separate the partially vaporized initial LNG stream into a methane enriched overhead gas stream and into an ethane enriched liquid product stream, d) warming the methane enriched gas stream, e) compressing the warmed methane enriched gas stream in a methane compressor having a discharge pressure, and cooling the compressed methane enriched gas stream to a temperature at or near ambient, f) further cooling the compressed and cooled methane enriched gas stream to liquid state, g) and distributing the compressed and liquefied methane enriched gas stream into two streams, one of which is expanded and then introduced to the top of the distillation column as a reflux, and the other of which is expanded and provided as a methane product, h) and wherein the methane compressor discharge pressure decreases.

13. A process for enriching LNG in methane, comprising the steps:

a) feeding an initial LNG stream to flow in a first path in a heat exchanger wherein the LNG stream partially vaporizes, b) feeding the partially vaporized initial LNG stream into a middle region of a distillation column that has a concentration section and a stripping section, c) operating the distillation column to separate the partially vaporized initial LNG stream into a methane enriched overhead gas stream and into an ethane enriched liquid product stream, d) warming the methane enriched gas stream while flowing in a second path in the heat exchanger, e) compressing the warmed methane enriched gas stream, and cooling the compressed methane enriched gas stream to a temperature at or near ambient, f) further cooling the compressed and cooled methane enriched gas stream to liquid state while flowing in a third path in the heat exchanger, g) and distributing the compressed and liquefied methane enriched gas stream into two streams, one of which is expanded and then introduced to the top of the distillation column as a reflux, and the other of which is expanded and provided as a methane product, h) and wherein said other stream is derived from said one enriched liquefied gas stream by separation in the column, and prior to said expansion of said other stream.

* * * * *